US009995544B1

(12) United States Patent
Akimov

(10) Patent No.: US 9,995,544 B1
(45) Date of Patent: Jun. 12, 2018

(54) PISTOL LOADING ASSISTANT

(71) Applicant: Andrei Fedorovich Akimov, Duluth, GA (US)

(72) Inventor: Andrei Fedorovich Akimov, Duluth, GA (US)

(73) Assignee: Andrei Fedorovich Akimov, Duluth, GA (US)

( * ) Notice: Subject to any disclaimer, the term of this patent is extended or adjusted under 35 U.S.C. 154(b) by 0 days. days.

(21) Appl. No.: 15/588,580

(22) Filed: May 5, 2017

(51) Int. Cl.
*F41A 3/72* (2006.01)
*F41C 27/00* (2006.01)
*F41A 9/38* (2006.01)

(52) U.S. Cl.
CPC ..... *F41A 3/72* (2013.01); *F41A 9/38* (2013.01); *F41C 27/00* (2013.01)

(58) Field of Classification Search
CPC ..... F41A 3/72; F41A 9/38; F41C 27/00
USPC ..... 89/1.4; 42/106, 90
See application file for complete search history.

(56) References Cited

U.S. PATENT DOCUMENTS 3,763,587 A * 10/1973 Firmalino ..... F41A 19/34 224/249
4,823,671 A * 4/1989 Buryta ..... F41A 3/72 42/106
6,775,940 B2 * 8/2004 Dworzan ..... F41A 9/53 42/1.01
7,543,404 B2 * 6/2009 Kovalchuk ..... F41C 33/0263 224/192
8,312,803 B2 * 11/2012 Oz ..... F41A 19/34 42/71.02
9,157,691 B2 * 10/2015 Parnell ..... F41A 3/72
9,194,654 B1 * 11/2015 Viani ..... F41A 3/72
9,239,207 B2 * 1/2016 Kresser ..... F41C 3/00
9,500,439 B1 * 11/2016 Dietrich ..... F41A 3/72
2007/0163164 A1 * 7/2007 Avrahami ..... F41C 33/0227 42/87
2011/0088539 A1 * 4/2011 Oz ..... F41A 19/34 89/1.4
2011/0154710 A1 * 6/2011 Hatfield ..... F41A 19/34 42/90
2013/0111799 A1 * 5/2013 Lee ..... F41C 27/00 42/106
2013/0255478 A1 * 10/2013 McAninch ..... F41A 7/00 89/1.4
2015/0121734 A1 * 5/2015 Kresser ..... F41A 3/72 42/16
2015/0184959 A1 * 7/2015 Parnell ..... F41A 7/00 89/1.4

(Continued)

*Primary Examiner* — Joshua E Freeman

(57) ABSTRACT

The present invention relates generally to firearms and devices that allow a shooter to load an automatic pistol inside a locked holster. The problem of existing devices is that they do not allow to load a gun locked inside a holster and with one hand only. The present invention is intended to solve this problem. Pistol Loading Assistant—is a device in the form of an insert for a holster, allowing a shooter to load a pistol when it is in a holster in a locked position with a short move of one hand. A shooter moves pistol slide with device inside a locked holster and loads pistol with a cartridge. Charging hook of device covers safety lever of pistol from one side increasing safety. Device jointed with holster with locking cord and can provide convenient, easy and safe pistol loading with small physical efforts.

1 Claim, 3 Drawing Sheets

(56) References Cited

U.S. PATENT DOCUMENTS

| | | | | |
|---|---|---|---|---|
| 2015/0233663 | A1* | 8/2015 | Kiehn | F41A 33/00<br>42/90 |
| 2015/0354909 | A1* | 12/2015 | Tarantino | F41A 3/72<br>89/1.4 |
| 2016/0102938 | A1* | 4/2016 | Sroufe | F41A 3/72<br>42/16 |

* cited by examiner

PISTOL LOADING ASSISTANT

BACKGROUND OF THE INVENTION

The use of automatic pistols for the past 100 years has revealed many shortcomings in their application and carrying. The most considerable may include: impossibility of loading a pistol when positioned is in a holster; necessity to use both hands of a shooter for loading a pistol. Besides, it is impossible to provide the maximum speed, safety, simplicity, ease, reserve and suddenness during a pistol loading, especially in situations when a shooter is injured or wounded in a combat situation or when using a pistol by people with limited physical abilities. In the devices developed by other authors they have attempted to find a solution for the above-stated shortcomings by using different designs for the devices, but they have not used the existing holsters as an element of a design; they created new devices for carrying pistols that are more technically and technologically complicated in their production and usage than the existing holsters and, therefore, more expensive in their production and less reliable in many parameters. There are other devices that are simple in production but less convenient in their operation, or they are not fully considering and optimizing kinematics of movements of a shooter during pistol loading. Some of these other devices often do not have basic positive operational features of the holsters.

BRIEF SUMMARY OF THE INVENTION

Pistol Loading Assistant is a device for loading a automatic pistol positioned in a locked holster. Motionless fixing of a pistol in a holster also allows a pistol slide to move freely on the working course of a slide. Pistol Loading Assistant consists of a U-shape case made of sheet metal or reinforced plastic and a slide cord (made of Aramid fiber or similar materials) that prevents Pistol Loading Assistant from falling out of a holster when extracting a pistol. A pistol installed in working position in Pistol Loading Assistant can be loaded by a shooter at any time per shooter's intension with back and forth motion with one hand without taking a pistol out off a holster. Pistol Loading Assistant blank can be cut with one of appropriate technological methods from one piece of sheet material, banded and conjoined to achieve the designed shape to fit geometrical and design particulars of a specific pistol model.

1—Pistol Loading Assistant.
23—Pistol locked in a holster.
3—Holster.

Figure 2:
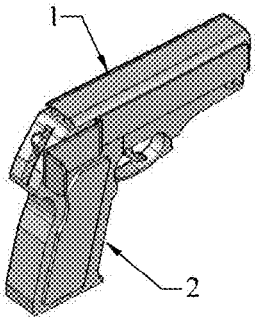

FIG. 2 Pistol in Pistol Loading Assistant front-top isometric view:

1—Pistol Loading Assistant.
2—Pistol.

Figure 3:
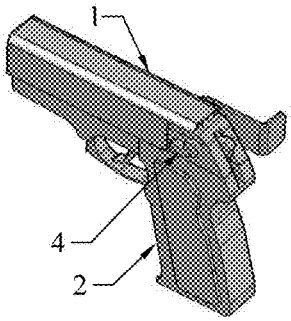

FIG. 3 Pistol in Pistol Loading Assistant back-top isometric view:

1—Pistol Loading Assistant.
2—Pistol.
4—Pistol safety lever.

Figure 4:
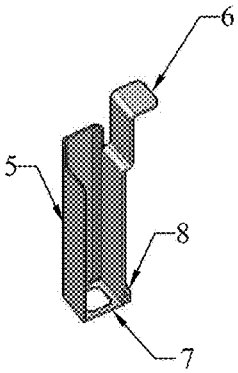

FIG. 4 Pistol Loading Assistant left-bottom isometric view:

5—U-shape case.
6—Charging hook.
7—Guide plate.
8—Connector for locking cord.

Figure 5:
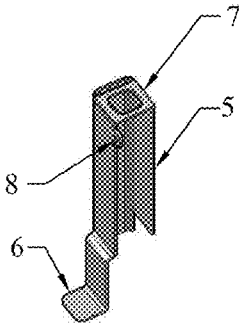

FIG. 5 Pistol Loading Assistant right-bottom isometric view:

5—U-shape case.
6—Charging hook.
7—Guide plate.
8—Connector for locking cord.

Figure 6:
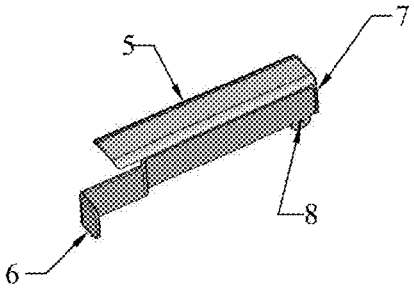

FIG. 6 Pistol Loading Assistant front-top view:

5—U-shape case.
6—Charging hook.
7—Guide plate.
8—Connector for locking cord.

Figure 7:
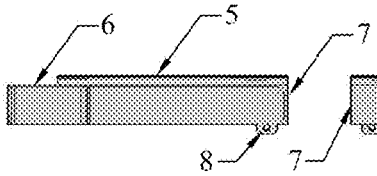

FIG. 7 Pistol Loading Assistant orthogonal view from the front:

5—U-shape case.
6—Charging hook.
7—Guide plate.
8—Connector for locking cord.

Figure 8:
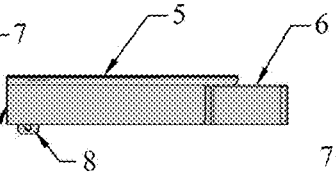

FIG. 8 Pistol Loading Assistant orthogonal view from the back:

5—U-shape case.
6—Charging hook.
7—Guide plate.
8—Connector for locking cord.

Figure 9:
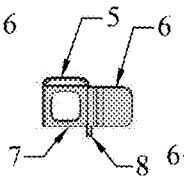

FIG. 9 Pistol Loading Assistant orthogonal view from the left:

5—U-shape case.
6—Charging hook.
7—Guide plate.
8—Connector for locking cord.

Figure 10:
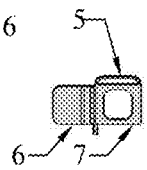

FIG. 10 Pistol Loading Assistant orthogonal view from the right:

5—U-shape case.
6—Charging hook.
7—Guide plate.

Figure 11:
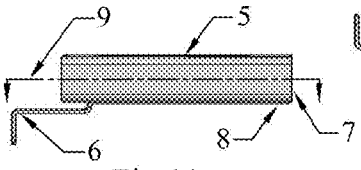

FIG. 11 Pistol Loading Assistant orthogonal view from the top:

5—U-shape case.
6—Charging hook.
7—Guide plate.
8—Connector for locking cord.
9—Pistol Loading Assistant longitudinal section.

Figure 12:
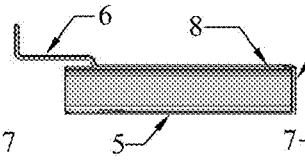

FIG. 12 Pistol Loading Assistant orthogonal view from the bottom:

5—U-shape case.
6—Charging hook.
7—Guide plate.
8—Connector for locking cord.

Figure 13:
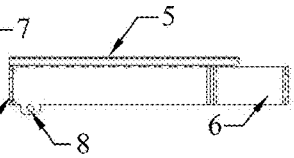

FIG. 13 Pistol Loading Assistant section view:

5—U-shape case.
6—Charging hook.
7—Guide plate.
8—Connector for locking cord.

Figure 14:
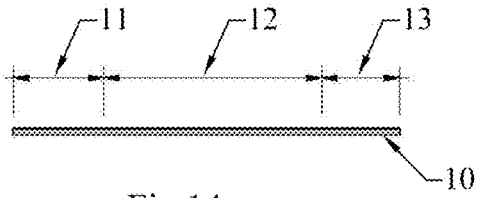

FIG. 14 Determination of the length of locking cord for Pistol Loading Assistant:

10—Locking cord.
11—Sized cord to make a knot with Pistol Loading Assistant.
12—Sized cord to a holster size.
13—Sized cord to make knot with a holster.

Figure 15:
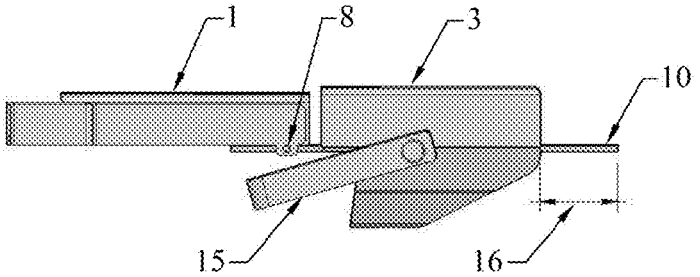

FIG. 15 Positioning of locking cord in a holster.

1—Pistol Loading Assistant.
3—Holster.
8—Connector for locking cord.

10—Locking cord.

15—Holster locking system.

16—Sized cord to make knot with a holster.

Figure 16:
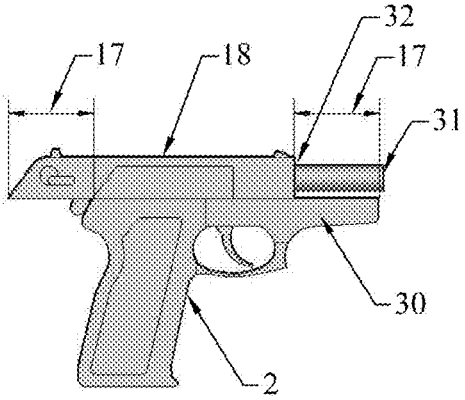

FIG. 16 Measurement of the distance of rearward travel of pistol slide.

2—Pistol.

17—Distance of rearward travel of pistol slide.

18—Pistol slide.

Figure 17:
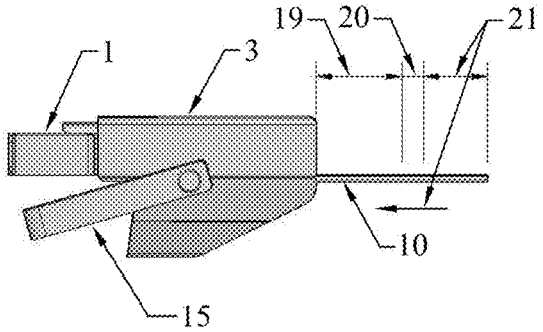

FIG. 17 Positioning lock cord in a holster, junction between Pistol Loading Assistant and a holster with a lock cord, lock cord final sizing with Pistol Loading Assistant inside a holster.

1—Pistol Loading Assistant.

3—Holster.

10—Locking cord.

15—Holster locking system.

19—Pull lock cord fastened with Pistol Loading Assistant in and out of a holster on a size of a equal distance of rearward travel of pistol slide.

20—Extra cord size for compensation of potential movement of recoil spring, on a distance that exceeds the rearward travel of pistol slide during pistol loading procedure to prevent malfunctioning.

21—Final locking cord sizing: make a knot outside a holster and pull locking cord inside to a holster by using Pistol Loading Assistant.

Figure 18:
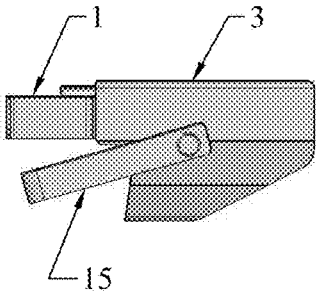

FIG. 18 Initial position of Pistol Loading Assistant in a holster.

1—Pistol. Loading Assistant.

3—Holster.

15—Holster locking system.

Figure 19:
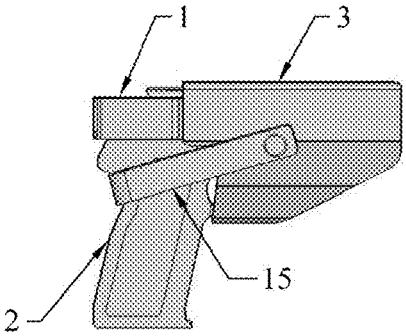

FIG. 19 Working position of a pistol in Pistol Loading Assistant/holster.

1—Pistol Loading Assistant.

2—Pistol.

3—Holster.

15—Holster locking system.

Figure 20:
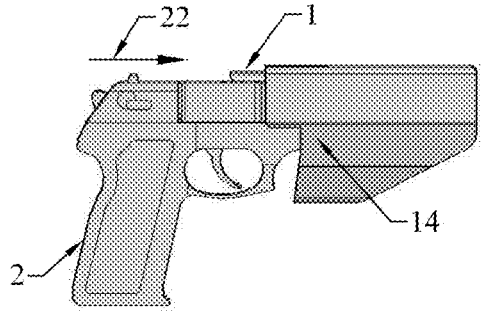

FIG. 20 Step 1 of pistol loading by means of Pistol Loading Assistant.

1—Pistol Loading Assistant.

2—Pistol.

14—Holster, holster locking system not shown.

22—Inserting pistol into Pistol Loading Assistant/holster.

Figure 21:
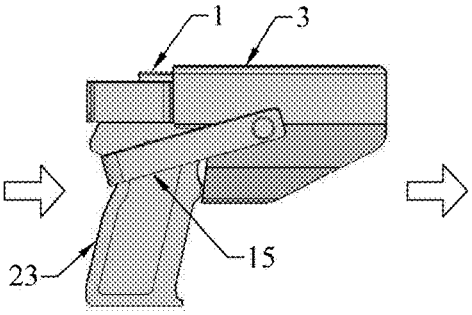

FIG. 21 Step 2 of loading pistol by means of Pistol Loading Assistant. Locking pistol in Pistol Loading Assistant/holster.

1—Pistol Loading Assistant.

3—Holster.

15—Holster locking system.

23—Pistol locked in a holster.

Figure 22:
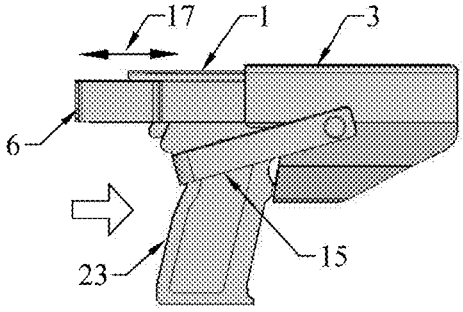

FIG. 22 Step 3 of loading pistol by means of Pistol Loading Assistant.

1—Pistol Loading Assistant.

3—Holster.

3—Charging hook.

15—Holster locking system.

17—Distance of rearward travel of Pistol Loading Assistant/slide

23—Pistol locked in a holster.

Figure 23:
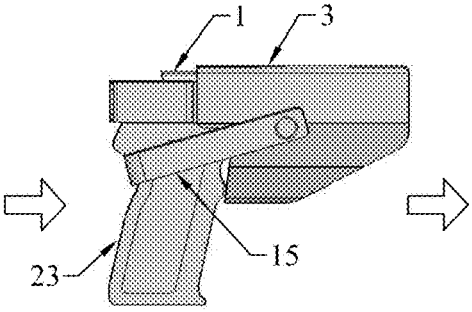

FIG. 23 Step 4. Loaded pistol in Pistol Loading Assistant/holster.

1—Pistol Loading Assistant.

3—Holster.

15—Holster locking system.

23—Pistol locked in a holster.

Figure 24:
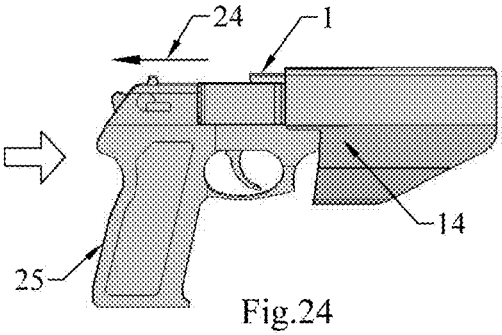

FIG. 24 Step 5. Loaded pistol is ready to shoot.

1—Pistol Loading Assistant.

14—Holster, holster locking system not shown.

24—Release loaded pistol from Pistol Loading Assistant/holster.

25—Loaded pistol unlocked from a holster.

Figure 25:
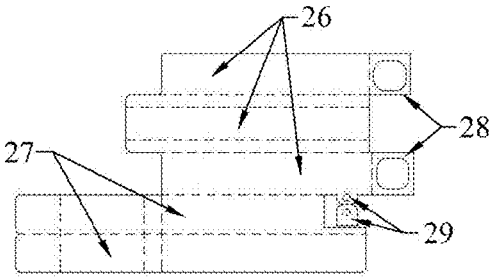

FIG. 25 Schematic design of the flat blank for Pistol Loading Assistant manufacture.

26—Pistol Loading Assistant U-shape case constructive zone.

27—Pistol Loading Assistant charging hook constructive zone.

28—Pistol Loading Assistant guide plate constructive zone.

29—Pistol Loading Assistant connector for locking cord constructive zone.

Dash lines on FIG. 13 and FIG. 25 represent banding lines for forming Pistol Loading Assistant 3-Dimensional structure from flat blank.

DETAILED DESCRIPTION OF THE INVENTION

Figure 1:
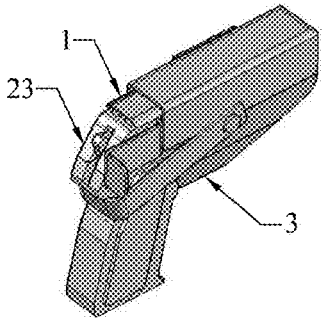
FIG. 1 Pistol in Pistol Loading Assistant/holster front-top isometric view.

The invented device Pistol Loading Assistant 1, see FIG. 2 allows: to use Pistol Loading Assistant together with existing types of holsters 3, see FIG. 1; that creates new consumer and technical properties as well as following operational opportunities: to load a automatic pistol when pistol positioned in a locked holster, to load a pistol with back and forth motion of one hand; to provide quick, short, hidden movement for loading as the distance of the movement of a hand, holding charging hook 6 see FIG. 6, of Pistol Loading Assistant, is equal to the distance of rearward travel of the pistol slide 17, see FIG. 16. It is especially important at conceal carrying of a pistol on a belt, humeral or other suspension devices; and it also allows to load a pistol in extreme or combat situations. The device can be manufactured both for right-hand and left-hand versions that allows to expand its consumer qualities. Pistol Loading Assistant 1, see FIG. 1 inserted to a holster covers a pistol safety-decocking lever see FIG. 1 from one side of a pistol by charging hook 6, see FIG. 4, thereby ensuring additional safety when using and carrying a pistol. Geometrical configuration of its U-shape case 5, see FIG. 4, of Pistol Loading Assistant allows to provide access to a pistol safety-decocking lever 4, see FIG. 3 from other side by a thumb of a hand of a shooter from shooter's body side. Ergonomic design and position of a charging hook and its optimized kinematics provide reliability during pistol loading with the smallest physical efforts. The locking cord 10, see FIG. 14 reliably prevents Pistol Loading Assistant from falling out of a holster during a pistol extraction from a holster FIG. 24. There can be the following conditions as: due to oiling, pollution or moistening, the surface of the slide becomes so slippery that can't be captured securely by fingers of a shooter; that often makes it impossible to load a pistol. In such conditions Pistol Loading Assistant allows to help a shooter to load a pistol reliably and safely. Pistol Loading Assistant represents a spatial, one-piece design including four functional elements shown in the drawings FIG. 4, FIG. 5, FIG. 6: a U-shape case—5, a charging hook—6, a guide plate—7, a connector for locking cord—8. Pistol Loading Assistant has a connector for locking cord 8, see FIG. 6, for fastening Pistol Loading Assistant 1, see FIG. 15 and a holster 3, see FIG. 15 with a cord 10 FIG. 15, As shown in FIG. 15, FIG. 17, Pistol Loading Assistant is put in a holster and it is fixed in it with a locking cord 10. Extra size (5-10 mm) of a locking cord shown on 20, see FIG. 17, that allows Pistol Loading Assistant to be pulled back on the distance of rearward travel of slide for compensation for additional movement of a pistol recoil spring during pistol loading. When Pistol Loading Assistant 1, see FIG. 18 is installed in a holster 3, see FIG. 18, a pistol 2, see FIG. 19 can be installed in Pistol Loading Assistant 1, see FIG. 19. A pistol 2, see FIG. 20 installed in Pistol Loading Assistant 1, see FIG. 20 will be fixed inside Pistol Loading Assistant/holster FIG. 21 by a holster fixing device 15, see FIG. 21. To load a pistol, it is necessary for a shooter: to take Pistol Loading Assistant 1, see FIG. 22 by grasping a charging hook 6, FIG. 22 with one or two fingers and pull against a recoil spring of a pistol with a short intensive move to pull it in the direction of a slide of a pistol when loading. Guide plate 7, see FIG. 4, when Pistol Loading Assistant 1, see FIG. 22 is being pulled off a holster 3, see FIG. 22 and entering gearing with front end of a pistol slide 32, see FIG. 16, transfers the effort of a hand of a shooter; a guide plate 7, see FIG. 4, of Pistol Loading Assistant passes between the barrel 31, see FIG. 16 and the frame of a pistol 30, see FIG. 16, therefore ensures the proper functioning of Pistol Loading Assistant in the course of loading. Pull Pistol Loading Assistant with a pistol slide in the position when the cartridge is taken from a magazine, then release 17, see FIG. 22 a charging hook 6, see FIG. 22, of Pistol Loading Assistant, pistol slide and Pistol Loading Assistant will be moved to the initial position shown on FIG. 23 by a pistol recoil spring and a cartridge will load to a firing chamber; that puts firing mechanism in the fire position. In case if Pistol Loading Assistant malfunctions, when the force of compression of a recoil spring isn't enough to move a pistol slide with Pistol Loading Assistant or stops for any other reasons, it is necessary to push a charging hook 6, see FIG. 22 by pressing on its outer side and manually help a pistol slide and Pistol Loading Assistant finish the loading process. For prevention of the above-stated conditions, it is necessary to establish working gaps between Pistol Loading Assistant, a pistol and a holster ensuring the minimum friction, also it is possible to apply a coating on the surface of Pistol Loading Assistant with a layer of material with low friction coefficient that will reduce friction between Pistol Loading Assistant, a holster and a pistol. Same results can be achieved by means of mechanical, or electrochemical processing of the surfaces of Pistol Loading Assistant; that creates on surface of Pistol Loading Assistant some micropattern thereby reducing friction coefficient in the contact zone. One of additional benefits of Pistol Loading Assistant original design is simplicity in its manufacturing, as shown on FIG. 25, the entire Pistol Loading Assistant can be manufactured by cutting, banding and welding from one piece of material. Shape of Pistol Loading Assistant blank is a simple and geometrical configuration and its dimensions are easy to adjust to different pistol models and sizes. To increase durability of Pistol Loading Assistant and to reduce its weight (when thickness of the blank is decreased), it is necessary to form rigidity elements (as corrugated, stamped or checkered) on Pistol Loading Assistant surface at the areas of high mechanical tension that appears in Pistol Loading Assistant during loading process. The configuration and the arrangement of these rigidity elements can vary based on a gun model and not shown on the drawings. Formation of these rigidity elements on Pistol Loading Assistant can be made either before or after blank banding, and it depends on technological capabilities of a manufacturer. The dimension on FIG. 25 is not shown because it depends on: nominal size of details of a pistol, location and size of rigidity elements, thickness of used material for Pistol Loading Assistant blank and holster's configuration.

The invention claimed is:

1. A pistol loading assistant comprising: a pistol loading assistant with a body made in form of a u-shaped case with a charging hook, a guide plate, and a connector, said pistol loading assistant configured to receive a pistol; a holster connected to said pistol loading assistant with a locking cord, said locking cord attached to said connector at one end and attached said holster at an opposite end, said pistol loading assistant configured to be inserted into said holster; wherein said pistol loading assistant is configured to allow a user load said pistol fixed inside said locked holster using one hand.

* * * * *